US006406222B1

(12) United States Patent
Pollack

(10) Patent No.: US 6,406,222 B1
(45) Date of Patent: Jun. 18, 2002

(54) MOORING CONSTRUCTION

(75) Inventor: Jack Pollack, Monaco (MC)

(73) Assignee: Single Buoy Moorings, Inc., Marly (CH)

( * ) Notice: Subject to any disclaimer, the term of this patent is extended or adjusted under 35 U.S.C. 154(b) by 0 days.

(21) Appl. No.: 09/647,148

(22) PCT Filed: Mar. 23, 1999

(86) PCT No.: PCT/EP99/02048

§ 371 (c)(1),
(2), (4) Date: Sep. 27, 2000

(87) PCT Pub. No.: WO99/50136

PCT Pub. Date: Oct. 7, 1999

(30) Foreign Application Priority Data

Mar. 27, 1998 (EP) ..... 98200985

(51) Int. Cl.[7] ..... E02B 17/00
(52) U.S. Cl. ..... 405/224; 405/201
(58) Field of Search ..... 405/195.1, 196, 405/201, 202, 224, 224.2

(56) References Cited

U.S. PATENT DOCUMENTS

| | | | | |
|---|---|---|---|---|
| 4,459,066 A | * | 7/1984 | Van der Graaf | 405/195.1 |
| 4,576,516 A | * | 3/1986 | Denison | 405/195.1 |
| 4,648,459 A | * | 3/1987 | Biggs et al. | 405/195.1 |
| 4,913,238 A | | 4/1990 | Danazcko et al. | |
| 5,423,632 A | * | 6/1995 | Ekvall et al. | 405/224 |
| 5,427,180 A | * | 6/1995 | Leite et al. | 405/224.2 |
| 5,439,321 A | | 8/1995 | Hunter | |
| 5,887,659 A | * | 3/1999 | Watkins | 405/224.2 |
| 6,027,286 A | * | 2/2000 | Pollack | 405/195.1 |
| 6,230,645 B1 | * | 5/2001 | Chow | 114/264 |
| 6,244,785 B1 | * | 6/2001 | Richter et al. | 405/195.1 |

FOREIGN PATENT DOCUMENTS

| | | |
|---|---|---|
| FR | 2 729 636 | 7/1996 |
| GB | 2 274 476 | 7/1994 |

* cited by examiner

*Primary Examiner*—Thomas B. Will
*Assistant Examiner*—Alexandra K. Pechhold
(74) *Attorney, Agent, or Firm*—Young & Thompson

(57) ABSTRACT

A floating construction (11) such as for instance a SPAR buoy, which is connected to the seabed (32) by tethers and/or risers (15, 16). At the top part the floating construction (11) comprises a displacement member (17') mounted on a mounting frame (17). Two risers (15, 16) and/or tethers that are placed on respective sides of a vertical center line (22) of the mounting frame (17) are connected to the displacement members for causing oppositely directed and substantially equal displacements thereof upon tilting and/or the sideways excursion of the floating body (11). Hereby a substantially similar tension in the connecting elements (15, 16) is maintained. In one embodiment displacement member comprises a pivotable arm (5) or pivotable deck structure connected near the upper end of the floating body to provide a dry tree. Alternatively the displacement member may comprise pressure fluid cylinders (39) or a cable construction (51, 52). Preferably the floating construction is at its lower end provided with a pivotable guide casing to cause a gradual bending of the riser and/or tethers.

25 Claims, 10 Drawing Sheets

1
9
5
7
8
6
3
4
2

MOORING CONSTRUCTION

BACKGROUND OF THE INVENTION

The invention relates to a floating construction comprising a floating body having a lower part extending below water level and an upper part extending above water level, the floating body being connected to the sea bed by means of at least two substantially parallel connecting elements extending in a substantially straight line between the sea bed and the floating body.

For offshore well operations tension leg platforms (TLP) are used which are moored to the seabed by vertical tethers or tendons, which may be connected to opposite legs of partially submersed parts of the platform. Upon pitch or roll motions of the platforms, large and unevenly distributed tensional forces are exerted on the tethers.

SPAR buoys are also used in the offshore industry for drilling, hydrocarbon storage and/or transfer, a SPAR buoy comprising a slender floating body supporting several deck structures such as a well head deck, a manifold deck, a production well drilling deck and the like. The deep draft SPAR buoys, which may have a height of 150 meters or more, are relatively insensitive to wave induced motions and have a favourable heave and pitch-roll response. Two types of moorings are most prevalent for attaching SPAR buoys to the seabed. These comprise radially spaced catenary anchor lines or taut leg moorings and vertical tether moorings. From the well head, one or more risers extend upward to the SPAR buoy for transferring hydrocarbons from the subsea well. The risers may be flexible or may comprise a rigid steel casing.

According to one known construction, the risers extend along the outside of the floating SPAR buoy and are fixed to the riser attachment deck. A tensioned tether is attached to the lower end of the SPAR buoy such that the natural heave period generally is less than 5 seconds. Upon drift of the SPAR buoy, the tether will be displaced from its vertical position. Due to mean and dynamic wave motions, a relative angular motion (pitch-roll) of the SPAR buoy and the tether occurs which will cause a slackening of the risers on one side of the tether and an overtensioning of the risers on the opposite side of the tether. This unequal load distribution may lead to fatigue weakening which may result in failure of the risers.

From U.S. Pat. No. 4,702,321 a free floating SPAR construction is known wherein the riser movement is decoupled from the SPAR buoy movements. In the SPAR buoy that is described in the above mentioned document, a number of risers extend upwards through the central well of the floating SPAR body to a dry production deck. Each riser is at its upper end buoyantly supported by a buoyancy tank situated around the respective riser. As the risers are free at their upper ends, they can axially slide up and down in the well. The SPAR buoy is moored to the seabed by taut lateral moorings, such that the natural heave period of the known construction is larger than 25 seconds. When the known SPAR buoy is tilted, overtensioning of the risers is prevented by the axial sliding motion of the risers within the well. However, the riser motion inside the well causes significant wear. Furthermore, the known construction has a relatively large diameter in order to accommodate the riser buoyancy tanks and is therefore relatively sensitive to current and wave induced motions. Also, in case of rupture of one of the risers, the hydrocarbons will spill into the confined well. In view of the absence of natural ventilation, this may result in a danger of explosions.

It is therefore an object of the present invention to provide a mooring construction that avoids overtensioning of the elements extending between the sea bed and the floating body, which is of a relatively simple construction and which has a relatively small volume.

It is a further object of the present invention to provide a mooring construction which has a stable deck orientation.

It is again another object of the present invention to provide a mooring construction which can be easily installed.

It is a further object of the present invention to provide a mooring construction wherein the inclination of the floating body from the vertical and the relative angle between the vertical center line of the floating body and the connecting elements may be limited.

It is again an object of the present invention to provide a mooring construction that limits the forces on the connecting elements during extreme weather conditions.

SUMMARY OF THE INVENTION

For this purpose, a floating construction according to the present invention is characterised in that the floating body comprises a mounting frame to which the upper parts of the connecting elements are movably attached, and a displacement member attached to the mounting frame and to the end parts of two connecting elements that are placed on respective sides of a vertical center line of the mounting frame for causing oppositely directed and substantially equal displacements of the connecting elements relative to the mounting frame upon tilting and/or a sideways excursion of the floating body to maintain a substantially similar tension in the connecting elements.

During a sideways excursion and/or during roll or pitch of the floating construction according to the present invention, the connecting elements will be maintained in a parallel relationship by the displacement member. Via the displacement member, one of the connecting elements is raised while the other is lowered by the same amount, such that the upper parts of two connecting members that are located on opposite sides of the longitudinal center line are maintained in a substantially horizontal plane. Hereby an overtensioning of the connecting elements is effectively prevented.

The present invention may be used for floating constructions such as mooring buoys, tension leg platforms, tankers and the like. The invention is particularly suitable for use in conjunction with SPAR buoys, which generally have a length dimension along the vertical center line which is at least five times larger than the width dimension. In this case the connecting elements, such as risers and/or tethers are placed on separate sides of the vertical center line of the SPAR buoy, that coincides with the vertical center line of the mounting frame. By the present invention overtensioning of the connecting elements, which may comprise risers and/or tethers, is prevented upon inclination of the center line of the SPAR buoy from the vertical.

In other embodiments, the vertical center line of the mounting frame does not coincide with the vertical center line of the vessel, for instance in case the mounting frame is placed on one side of a vessel.

In one embodiment of the floating construction according to the present invention, the displacement member comprises a pivotable arm. As used herein the term "arm" may also comprise a two-dimensional structure such as a deck construction. Each connecting element is pivotably connected to a respective end of the arm. The pivot arm allows limited vertical movement of the connecting elements while transferring excess tension in one connecting element to the other element having a smaller tension. In this manner a simple mechanism is provided for keeping the ends of the connecting elements in a substantially horizontal plane upon drift and/or pitch and roll of the floating body.

The connecting elements according to the present invention may comprise risers, tethers or both. When sufficiently strong, steel hard piping is used for the risers, it is envisaged that the floating body according to the invention may be anchored to the seabed by the use of the risers only. However, the floating body according to the present invention is preferably used in conjunction with one or more tethers, which may be connected to the floating body via a fixed or via a pivoting connection, which may include the mounting frame.

A preferred embodiment of a floating construction according to the present invention has a displacement member with at least two arms that are pivotably connected to one end of a respective hydraulic or pneumatic cylinder which is connected to the mounting frame. Each arm carries at its free end a connecting element. The hydraulic or pneumatic cylinders are mutually connected by a fluid duct. A constant volume of fluid is displaced between the cylinders upon movement of the floating body. Hereby the cylinders are actuated in opposite directions such that the tension in the connecting elements is substantially equalised. The use of pressure fluid cylinders is particularly useful upon installation of the risers, wherein additional cylinders can be added to the mounting frame as new risers are being put in place.

In another embodiment of a floating construction according to the present invention, the displacement member comprises two cable guide members, each connecting element being with its upper end attached to a respective end of a cable that extends from the first connecting element, via the cable guide members, to the second connecting element. The cable and cable guides form a relatively simple and light weight construction to maintain the connecting elements in a uniform tensile situation. The cable may comprise an elastic section, for instance a spring element to compensate for small secondary misalignments between the connecting elements that may be caused by bending of the riser casing near the lower part of the floating body such as at the SPAR/tether pivot, or by height variations in the seabed.

The floating structure may comprise a pivotable deck which is pivotably coupled to the connecting elements. The deck itself may act as the displacement member for the connecting elements, or may be pivotably connected to the displacement member. As the displacement member and the geometry of the parallel connecting elements cause the upper parts of the connecting elements to be located in a substantially horizontal plane, irrespective of the inclination of the floating body, the displacement member can effectively be used to keep a deck structure, such as the riser attachment deck, in a horizontal position.

In another embodiment of a floating construction according to the present invention, the mounting frame is situated at or near the upper part of the buoy, a guide frame being connected at or near the lower part. The connecting elements are guided through respective passages in the guide frame. The guide frame maintains the connecting elements in their proper position with respect to the floating body, and prevents the floating body from contacting the risers or tethers upon tilting.

The guide frame may be fixed to the floating body in a stationary manner, in which case a sliding movement of the connecting elements through the guide frame can occur. Alternatively, the guide frame is pivotably connected to the floating body. In this way, the guide frame remains properly aligned with respect to the connecting elements, and bending is reduced. Furthermore, by pivoting of the guide frame, the sliding movements of the connecting elements are reduced and a reliable operation during extreme weather conditions is achieved.

The guide frame may for each connecting element comprise a sleeve which is pivotably attached to a radial arm connected to the lower part of the floating body. The sleeves prevent excessive bending or buckling of the connecting elements. To prevent damage to the connecting elements, the sleeves can near their edges be provided with a relatively soft, preferably replaceable lining material. For the same reason, the connecting elements can in the region of the sleeves be provided with a contact member for contacting the internal wall of the sleeves.

To further reduce the angle of curvature of the connecting elements, the radial arms of the guide frame are connected to a central pivot at or near the longitudinal axis of the floating body, at or near the lower part thereof. A number of sleeves may be placed on a circular guide frame at spaced angular positions to accommodate a circular configuration of the connecting elements.

In a preferred embodiment, at least one tether is attached to the floating body. By the use of tethers a small natural period of the floating construction is achieved which is outside the region of significant wave excitation. Preferably the tethers are also passed through the guide frame to cause controlled bending. The tethers may be attached to the lower part of the floating body, to a pivoting part of the guide frame, to the upper part of the floating body or to the mounting frame. In a SPAR embodiment according to the present invention, the tethers and the risers are preferably alternatingly placed in a circular pattern so that they can be installed outside the SPAR body. This tether configuration also gives a better control of the horizontal movements of the SPAR.

The floating construction according to the present invention may be connected to the seabed via a template. Preferably the template has a compression space allowing an axial depression of the at least one tether. If during extreme weather conditions the tethers are depressed, buckling is prevented as the tethers can move down into the compression space.

In addition to the tethers, the floating construction may comprise at least two pairs of axially spaced mooring lines. In one embodiment, each of the spaced mooring lines has a first section extending from the seabed to a first guide element on the floating body, a second section extending axially from the first guide element to second guide element and a third section extending from the second guide element back in the direction of the seabed or towards the first section. By the use of the radial mooring, the SPAR and tether angles from the vertical and the relative angle between the SPAR and the tether can be minimised. Reduction of these angles reduces bending fatigue in the risers and tethers. Furthermore, the adjustment of the mooring lines, by one or more winches on the SPAR buoy, can bring the SPAR and tethers to a vertical orientation, which is favourable when drilling wells on the SPAR.

BRIEF DESCRIPTION OF THE DRAWINGS

Some embodiments of a mooring construction according to the present invention will by way of example be described in detail with reference to the accompanying drawings. In the drawings.

DETAILED DESCRIPTION OF THE INVENTION

Figure 1:
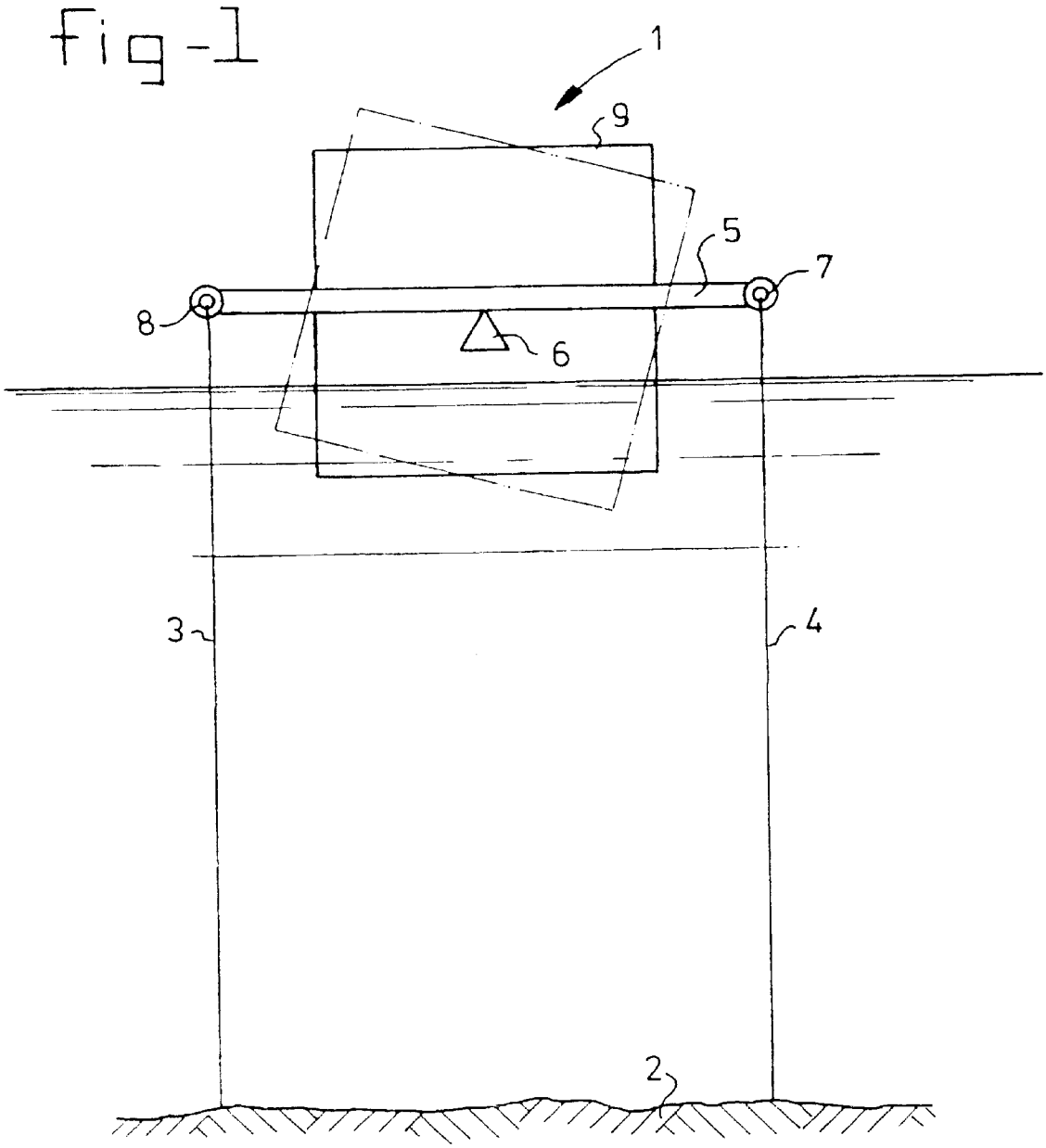
FIG. 1 shows a schematic side view of a floating construction comprising a displacement member according to the present invention.

FIG. 1 shows a floating construction 1 which may be a mooring buoy, a tension leg platform, a mono hull, or any other floating construction used in the offshore industry for well drilling, hydrocarbon production or storage. The floating construction 1 comprises a floating body 9 that is connected to the seabed 2 via connecting elements 3, 4. The connecting elements 3, 4 may comprise rigid or flexible risers, tethers or tendons, or combinations thereof. In case the connecting elements are formed by risers, the risers are supported and maintained in a substantially vertical position by the buoyancy of the floating construction 1. The connecting elements 3, 4 are connected to a displacement member 5 via pivoting connections 7, 8, the displacement member in this embodiment being schematically indicated as a pivoting arm. The displacement member 5 is mounted on the floating construction via a mounting frame schematically indicated at 6. Upon pitch or roll of the floating construction 1, the displacement member 5 will pivot with respect to the mounting frame 6 such that a substantially horizontal position of the arm 5 is maintained and the tension in connecting elements 3 and 4 is kept substantially equal.

Figure 2A:
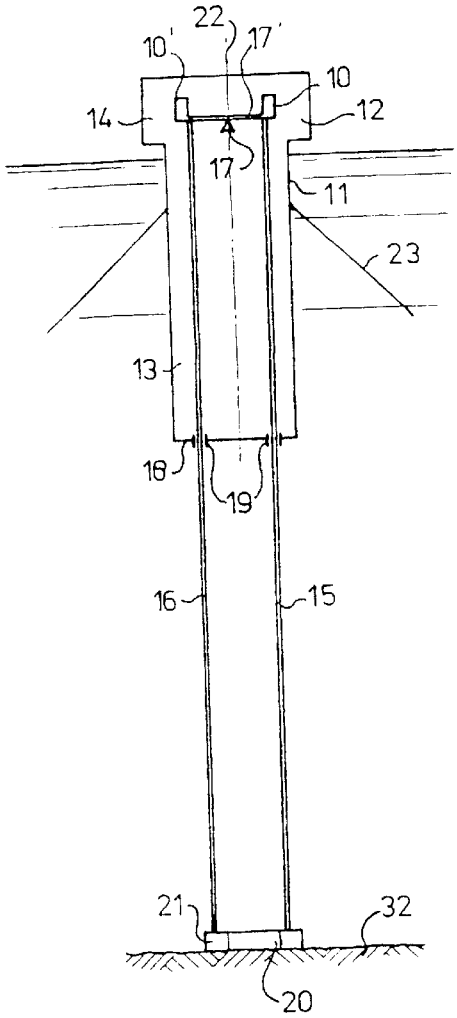
FIGS. 2*a* and 2*b* show a SPAR buoy construction wherein the risers are located in a central well and are passed through a fixed guide frame.

FIG. 2*a* shows an embodiment wherein the floating construction is formed by a SPAR buoy 11 having a top deck 12 with dry production trees 10, 10' and an elongate floating body 13 comprising buoyancy, ballast and storage tanks. At the upper part 14 of the SPAR buoy 11, risers 15 and 16 are connected to a displacement member in the form of a pivot arm 17'. The pivot arm 17' is connected to a mounting frame on the upper part 14 comprising a pivoting connection 17. At the lower part 18 of the SPAR buoy 11, the risers 15 and 16 pass through a rigid guide frame, or casing guide 19, for limiting the deflection of the risers when the SPAR buoy 11 is inclined from its vertical position. The risers 15 and 16 are connected to a well head 20 on the seabed 32 via a template 21.

Figure 2B:
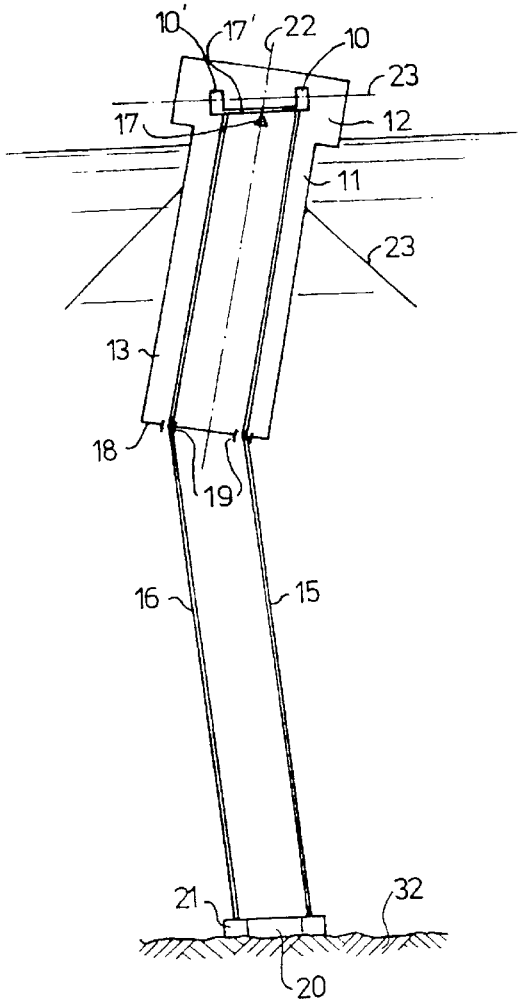

As can be seen in FIG. 2*b*, the risers 15 and 16 will contact the casing guide 19 upon sideways drift of the SPAR buoy 11 and will slide along the inner surfaces of the casing guide. Superimposed on the average sideways drift, the vertical center line 22 of the SPAR buoy 11 will be inclined from the vertical by dynamic wave movements. The pivot arm 17', at the ends of which the risers 15 and 16 are suspended, will maintain the top parts of the risers 15, 16 in a horizontal plane 23, irrespective of the position of the vertical center line 22 of the SPAR buoy 11. Hereby an overtensioning or slackening of the risers 15, 16 is prevented.

In the embodiments of FIGS. 2*a* and 2*b*, the SPAR buoy may be anchored to the seabed only by means of the risers 15 and 16 if sufficiently strong risers, such as for instance rigid steel piping, is used. Additional radial mooring lines 23 may be employed to minimize the inclination of the vertical center line 22 from the vertical caused by dynamic wave motions and to limit the sideways drift.

Figure 3A:
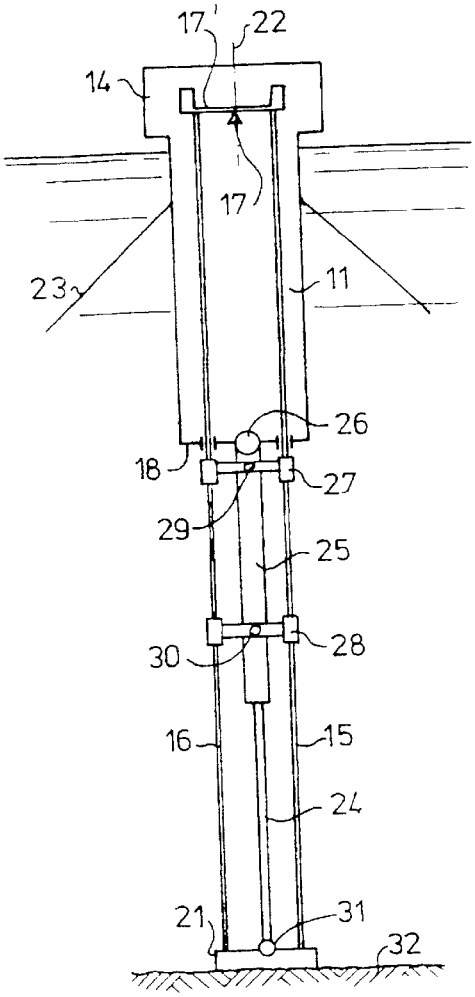
FIGS. 3*a* and 3*b* show a SPAR buoy construction wherein the risers are passed through a pivotable guide frame.
Figure 3B:
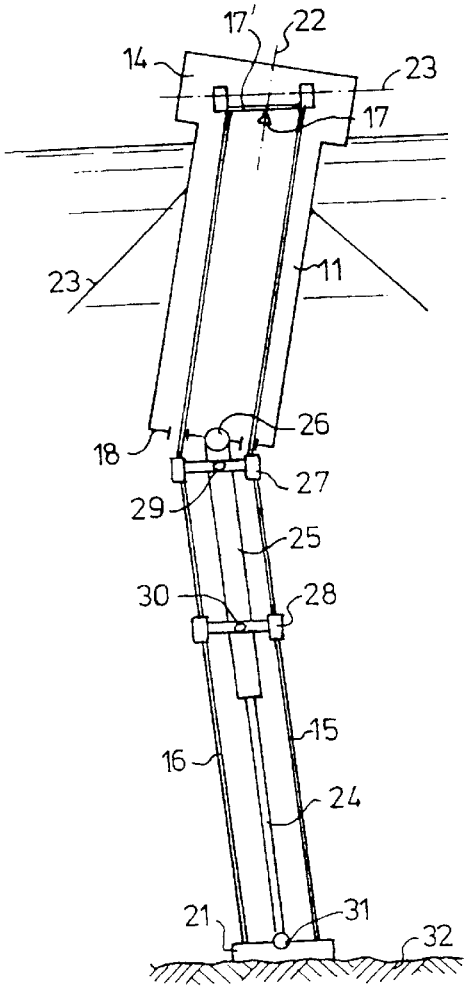

FIGS. 3*a* and 3*b* show an embodiment wherein the SPAR buoy 11 is anchored to the template 21 via a central tether 24. The upper part of the tether 24 is connected to the lower part 18 of the SPAR buoy 11 via a pivot connection 26. The upper part 25 of the tether 24 carries two casing guides 27, 28 which can each pivot in respective pivot points 29, 30. Herein the second casing guide 28 is optional and may be omitted. The tether 24 is at its lower end connected to the template 21 in a template pivot 31.

As can be seen in FIG. 3*b*, the casing guides 27, 28 will remain in a substantially perpendicular position with respect to the tether 24 when the tether 24 is deflected from its vertical position due to sideways drift of the SPAR buoy 11. Upon inclination of the vertical center line 22 of the SPAR buoy 11 from the vertical, the SPAR buoy 11 will tilt relative to the tether 24 in the pivot point 26. The casing guides 27, 28 will then pivot to cause a gradual bending of the risers 15, 16.

By movement of the pivot arm 17' with respect to the guide frame in pivot point 17 at the upper part 14, the top parts of the risers 15, 16 remain in the horizontal plane 23. In the way the seabed 32 and the upper casing guide 27 and the riser parts of the risers 15 and 16 extending therebetween define a first parallelogram. The upper parts of the risers 15 and 16 that are located in the horizonal plane 23, the upper casing guide 27 and the riser parts extending therebetween define a second parallelogram. In this configuration the tension in the risers 15 and 16 is substantially equalized.

Figure 4:
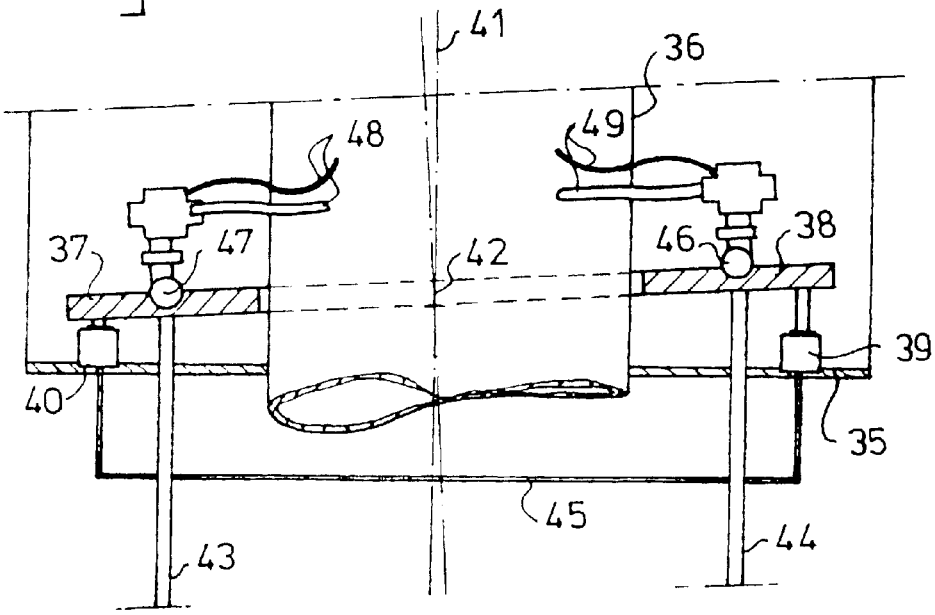
FIG. 4 shows a schematic partial side view of the upper part of a SPAR buoy, wherein the displacement member comprises pressure fluid cylinders.

FIG. 4 shows an embodiment wherein the displacement member acting upon the risers 43, 44 is formed by hydraulic cylinders 39, 40. The cylinders 39, 40 are mounted on a mounting frame 35 which is rigidly connected to an upper part 36 of the floating body. The upper parts of the risers 43, 44 are suspended from lateral arms 37, 38 by pivot connections 46, 47, which arms are with one end connected to the cylinders 39, 40. The arms 37, 38 may be part of a circular frame extending around the upper part of a floating body 36, out of the plane of the drawing. The upper parts of the risers 43, 44 are connected to the floating body via flexible piping 48, 49 to allow for relative movements between the upper part of the risers 43, 44 and the floating structure, a heave of about 3 meter between the risers 43, 44 and the mounting frame 35 being allowed. The cylinders 39, 40 are mutually connected via fluid duct 45 such that a constant volume of fluid, preferably a liquid, is moved between cylinders 39, 40 when the vertical center line 41 of the floating structure is inclined from its vertical position. Upon tilting of the mounting frame 35, the arms 37, 38 are moved with respect to the mounting frame 35 around the imaginary pivot point 42 on the vertical center line 41.

Figure 5:
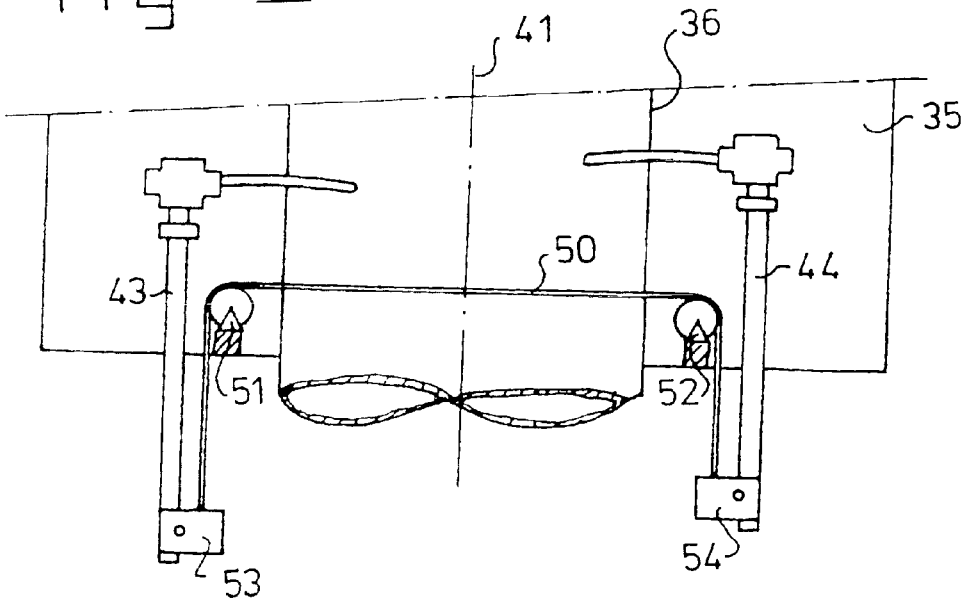
FIG. 5 shows a displacement member mean comprising a tensioning cable.

FIG. 5 shows an embodiment wherein the risers 43, 44 are coupled via a cable 50. The cable 50 is supported on sheaves 51, 52 which are placed on the mounting frame 35. The ends of the cable 50 are connected to suspension members 53, 54 at the end of the risers 43, 44.

Figure 6:
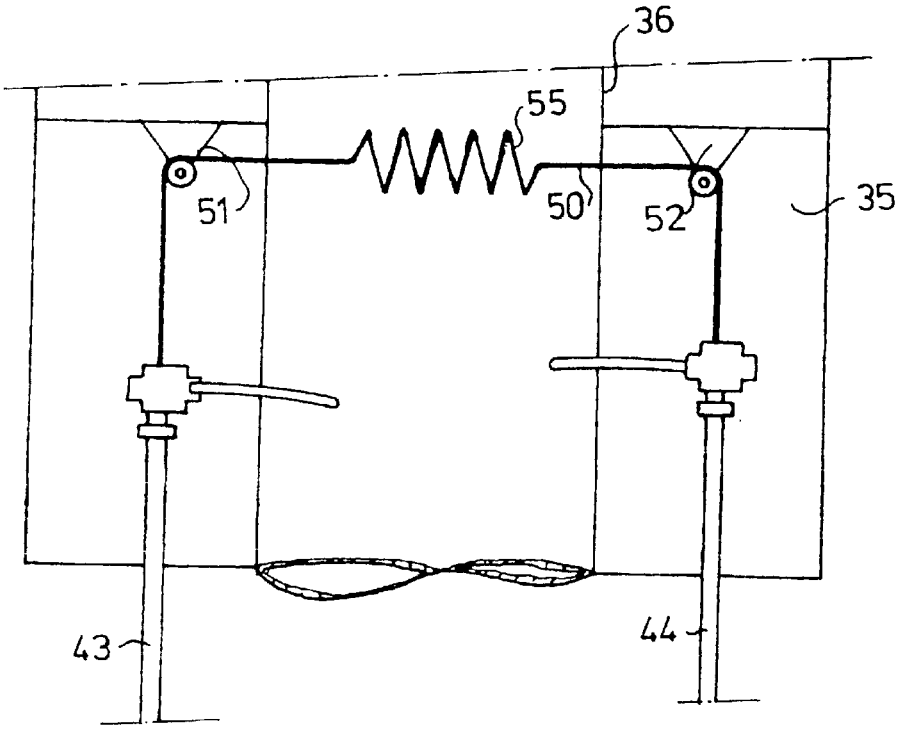
FIG. 6 shows a displacement member in the form of a tensioning cable having elastic compensating means.

In the alternative construction shown in FIG. 6, the sheaves, or pulleys 51, 52 are suspended from the mounting frame 35. The cable 50 comprises a spring member 55 for allowing a certain degree of independent movement of the risers 43, 44 such that secondary misalignments can be evened out.

Figure 7:
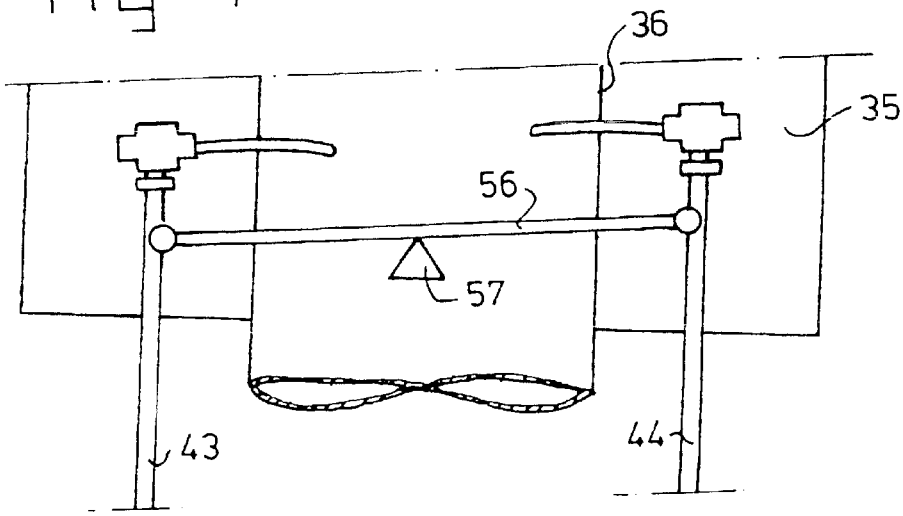
FIG. 7 shows a displacement member in the form of a pivoting arm.

FIG. 7 shows an embodiment wherein the risers 43, 44 are suspended from the ends of a pivot arm 56, which is connected to the mounting frame 35 in a pivot mounting 57. The pivot arm 56 can also be part of a two-dimensional construction such as a pivoting deck on which production or drilling equipment can be mounted in a stabilized horizontal position.

Figure 8:
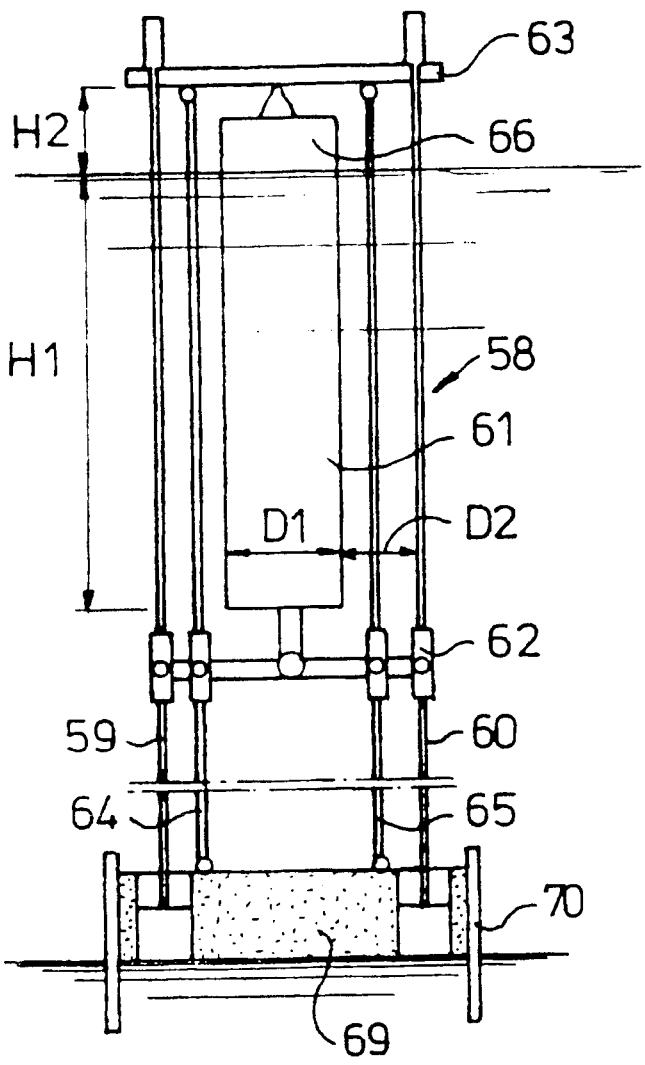
FIG. 8 shows a preferred embodiment wherein the tethers and the risers are connected to a pivotable deck structure at the upper end of the SPAR buoy and are each guided in a pivotable guide frame at the lower end of the buoy.

FIG. 8 shows a preferred embodiment wherein the risers 59, 60 and the tethers 64, 65 extend along the outside of the floating body 61. Both the risers and the tethers are guided through respective sleeves of the casing guide 62. The upper end of the risers and the tethers 59, 60, 64, 65 are connected to a pivoting deck 63 at the upper part 66 of the floating body 61. Preferably the risers and the tethers are alternatingly placed in a circular configuration. The lower part of the risers 64, 65 are connected to a template 69 on the seabed, which template is provided with a circumferential skirt 70. The circumferential skirt 70 provides an additional anchoring function of the template 69. In case of the extreme situation wherein the template 69 is moved upward, the skirt 70 will create a suction force between the seabed and the template which will work against the uplift of the template 69.

The construction shown in FIG. 8 may have a height H1 extending below sea-level of about 150 meters and a height H2 extending above sea-level of about 20 meters. The diameter D1 of the floating body 61 may be about 10 meters whereas the,distance D2 of the riser 60 from the outside of floating body 61 may be about 5 meters. According to this embodiment of the invention a small and relatively light weight production SPAR is provided which can be constructed at relatively low cost.

Figure 9:
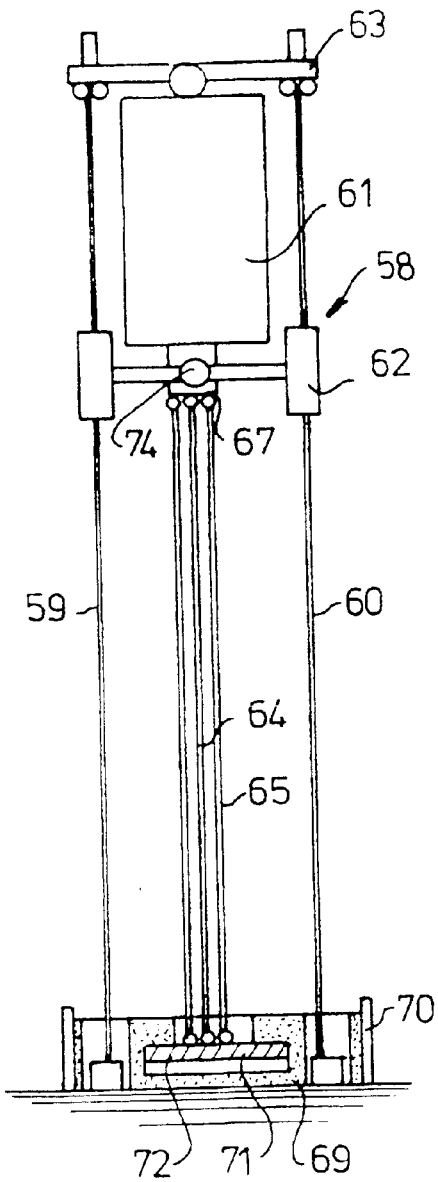
FIG. 9 shows an embodiment wherein the tethers are at one side connected to a fixed lower part of the SPAR buoy, and on the other side to a compression chamber in the template on the seabed.
Figure 11:
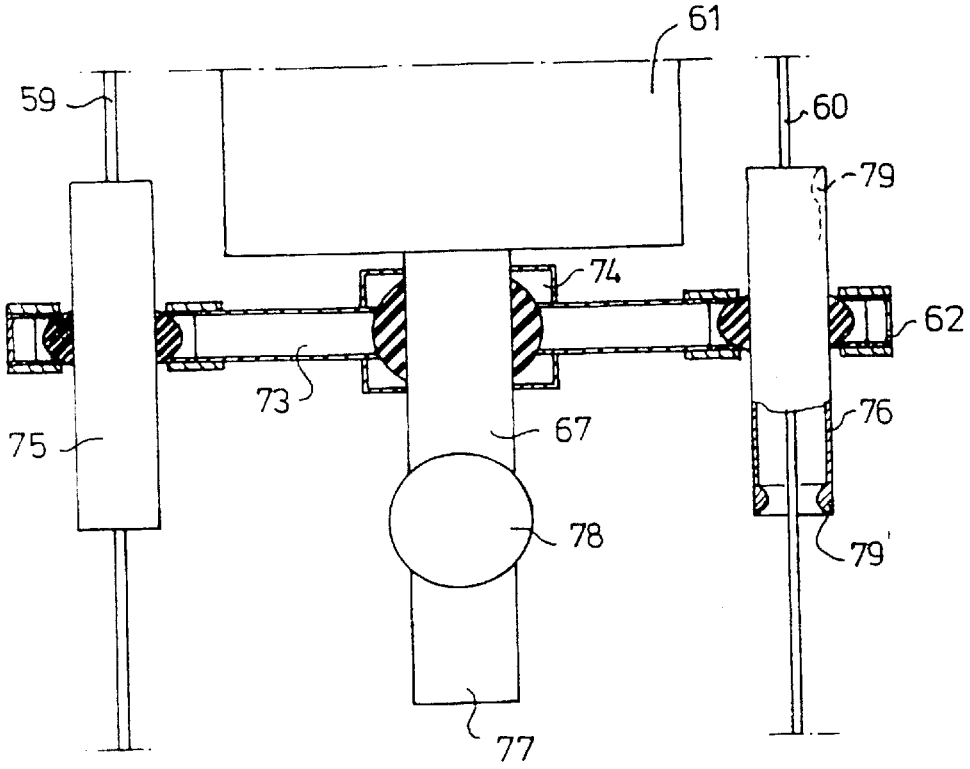
FIG. 11 shows a detail on an enlarged scale of the guide frame according to the present invention.

FIG. 9 shows an embodiment wherein a central group of tethers 64, 65 is connected to the lower part 67 of the floating body 61 of the SPAR buoy 58. The risers 59, 60 are placed at the outside of floating body 61 such that they can be easily installed. The risers 59, 60 are connected to the pivoting deck 63. In the embodiment of FIG. 11, the template 69 comprises a compression space 71 wherein an anchoring body 72, connected to the tethers 64, 65 is placed. When during extreme weather conditions the floating body 61 is lowered, the anchoring body 72 can move down into the compression space such that buckling of the tethers 64, 65 is prevented.

Figure 10:
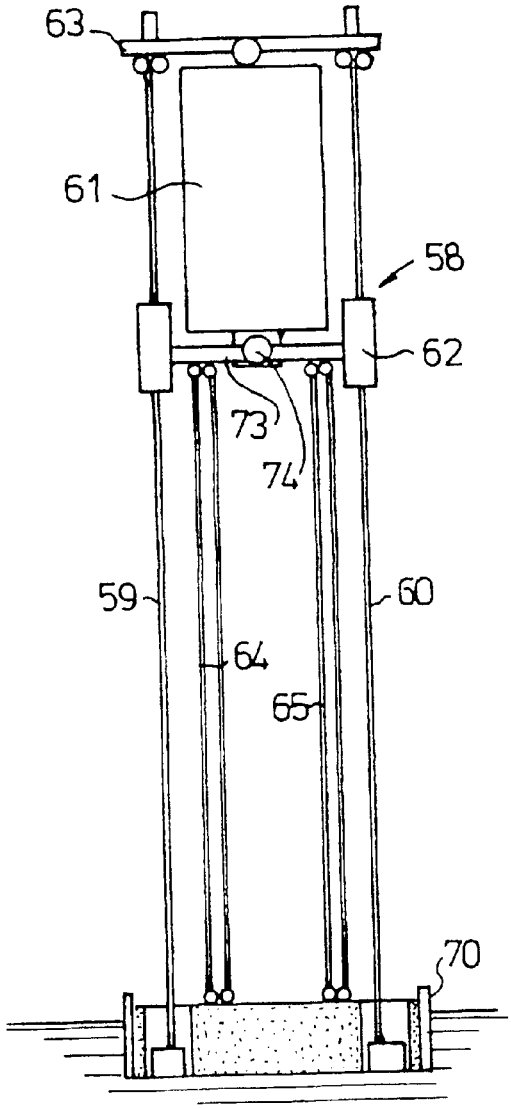
FIG. 10 shows the embodiment wherein the tethers are connected to pivoting parts of the guide frame

In the embodiment shown in FIG. 10, the tethers 64, 65 are connected to a radial arm 73 of the casing guide 62 on both sides of pivot joint 74. In this arrangement, the risers 59, 60 and the tethers 64, 65 may be placed in an alternating circular configuration which may comprise for instance three groups of two tethers and two risers each.

In a further embodiment of a SPAR buoy 58 the risers 59, 60 may extend through an internal shaft or central well of the floating body 61 and may with their upper parts be connected to the pivoting arm or pivoting deck 63, carrying the production trees. The tethers 64, 65 may extend outside of the floating body 61 and may be connected to a fixed upper part 66 of floating body 61 or pivoting deck 63.

FIG. 11 shows an enlarged detail of the radial arm 73 of the casing guide 62 that is attached to the lower part 67 of the floating body 61. The pivot joint 74 is formed by a resilient pivot element which may be made of rubber. The sleeves 75, 76 of the casing guide 62 are connected to the radial arm 73 via flexible pivoting connection, for instance via a rubber connection. When the floating body 61 is tilted with respect to the tether 77 in the pivot joint 78, the risers 59, 60 will contact the inner walls of the sleeves 75, 76. Hereby the sleeves will be deflected in their flexible pivot joints such that a gradual bending of the risers 59, 60 is ensured. The inner edges of the sleeves 75, 76 are provided with replaceable protecting rings 79, 79' which are made of a compliant material to prevent wear of the risers 59, 60. The protecting rings 79, 79' may for instance be made of rubber.

Figure 12A:
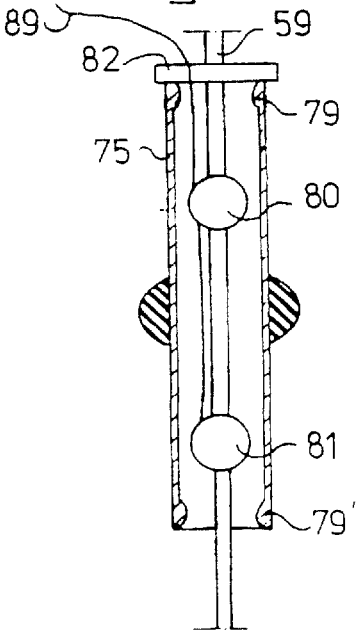
FIGS. 12*a* and 12*b* show contact members on the risers and/or the tethers for limiting the bend radius.

As is shown in FIG. 12*a*, the riser 59 may be provided with bumpers 80, 81 which prevent direct contact of the riser 59 with the inner walls of the sleeve 75. A stopper 82 may be provided around and is connected to the bumpers 80, 81 to properly position the bumpers 80, 81 inside the sleeve 75. The spacer 82 and the bumpers 80, 81 may be raised or lowered from the deck of the SPAR buoy via a cable 89 for removal or replacement. The protecting rings 79, 79' of FIG. 11 may be positioned and replaced in a similar manner.

Figure 12B:
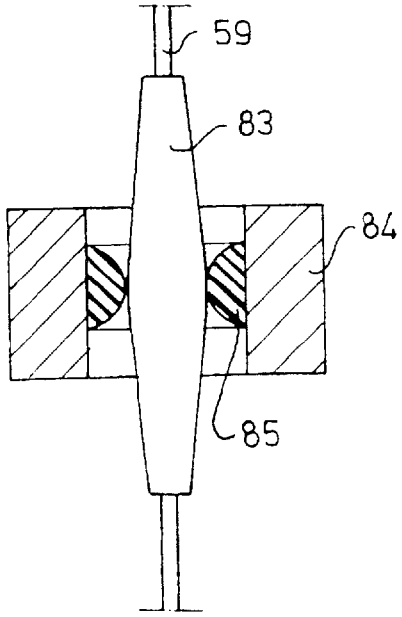

FIG. 12*b* shows an alternative embodiment wherein the riser 59 is provided with a double stress joint 83 and guided through a ring 84 which is on an internal surface provided with a rubber element 85 for causing a gradual bending of the riser 59. The ring 84 may be used as an alternative for the guide sleeves 75.

Figure 13:
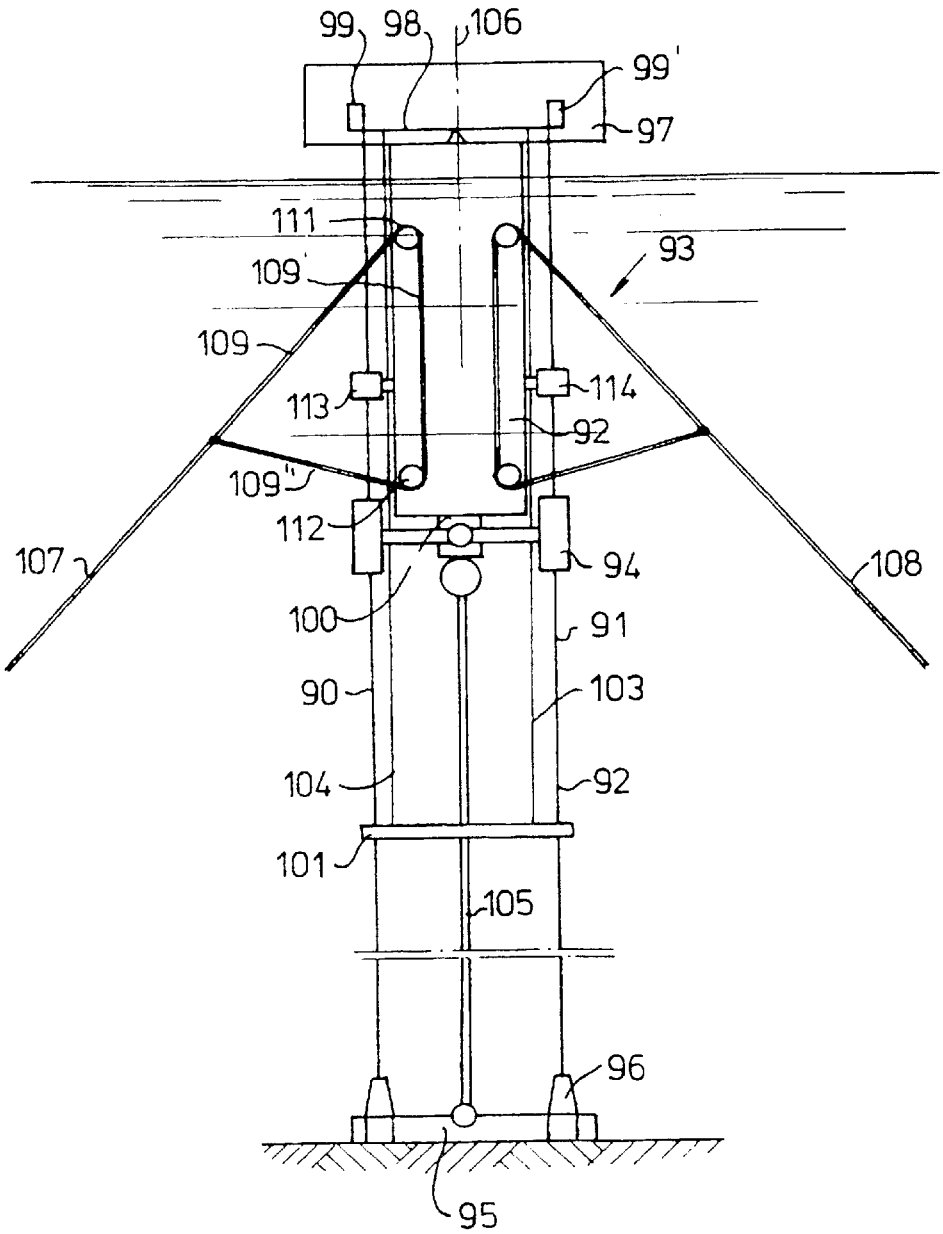
FIGS. 13 and 14 show lateral mooring arrangements of a SPAR buoy construction according to the present invention.

FIG. 13 shows a further embodiment of a SPAR buoy 93 according to the present invention wherein the risers 90, 91 are placed outside the floating body 92 of the spar buoy 93. The risers 90, 91 are formed of hard pipe risers connected to the template 95 via stress joint 96. The risers 90, 91 are at the upper part 97 supported by a pivoting arm or deck 98, which carries the production trees 99, 99'. The lower part 100 of the floating body 92 carries a vertically adjustable riser spacer 101 which is suspended from spacer lines 103, 104. A central tether 105 is pivotably connected to the lower part 100 of floating body 92 and at a lower side to the template 95. On each side of the vertical center line 106 of the floating body 92 a mooring line 107, 108 is provided. Each mooring line comprises a first section 109 extending from the seabed towards an upper sheave 111. A second section 109' of the mooring line 107 extends towards a lower sheave 112 and a third section 109" is reconnected back to the first section 109. By turning the sheaves 111, 112 the tension in the anchor lines 107, 108 can be varied and the lateral drift of this SPAR buoy 93 and the inclination of the vertical center line 106 from the vertical can be minimized. Examples of a mooring system for effective reduction of average and dynamic angles of a similar type is described in U.S. patent application Ser. No. 08/879,261 in the name of Imodco. Reduction of the dynamic and mean deflection of the SPAR buoy 93 is beneficial for the risers and the tethers as bending fatigue is hereby reduced. Also the ability of adjusting the anchor lines 107, 108, which may be formed by cables, ropes, chains or combinations thereof, to maintain the SPAR buoy 93 and the tether 105 in a vertically aligned position is especially desirable when the SPAR buoys is used for well drilling. By keeping the risers 90, 91 outside the floating body 92, space is created for accomodating the sheaves 111, 112 and the anchor lines 107, 108. For proper positioning, the risers may be guided through additional fixed casing guides 113, 114, that are placed on the floating body.

Figure 14:
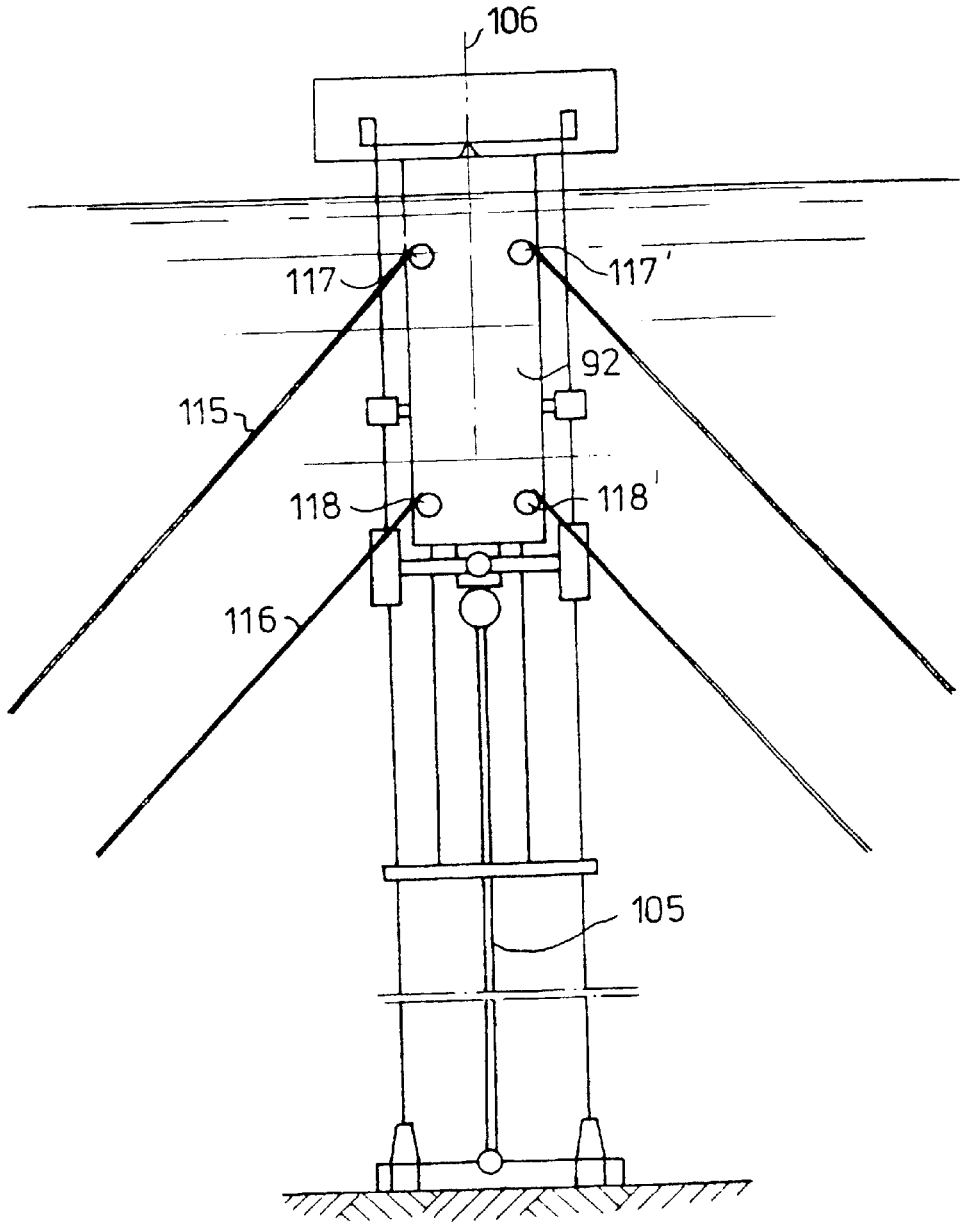

FIG. 14 shows a further embodiment of a lateral mooring system in which an upper and a lower anchor line 115, 116 extend upwards from the seabed, through the floating body 92 via sheaves 117, 117', back to the seabed on the other side of the vertical centerline 106. By taking in or slackening the anchor lines 115 and 116, the tether 105 can be vertically alined and the inclination of the vertical center line 106 from its vertical position can be minimized.

What is claimed is:

1. Floating construction (1,11,58) comprising a floating body (9,13,61,92) having a lower part (18,67,100) extending below water level and an upper part (14,36,66,97) extending above water level, the floating body being connected to the sea bed by means of at least two substantially parallel connecting elements (3,4; 15,16; 59,60,64,65) extending in a substantially straight line between the sea bed and the floating body, characterised in that the floating body comprises a mounting frame (6,17,35) to which upper parts of the connecting elements are movably attached so as to be movable relative to the mounting frame, and a displacement member (5,17'; 39,40; 50,51,52; 56,63) attached to the mounting frame and to end parts of the at least two connecting elements (3,4; 15,16; 43,44; 59,60; 64,65) that are placed on respective sides of a vertical center line (22,41, 106) of the mounting frame, the displacement member being adapted to cause oppositely directed and substantially equal displacements of the connecting elements, in the length direction thereof, relative to the mounting frame upon tilting of the floating body to maintain a substantially similar tension on the connecting elements, the upper part remaining above water level.

2. Floating construction according to claim 1 having a length dimension along the vertical center line (22,41,106) and a width dimension, the length dimension being at least five times larger than the width dimension.

3. Floating construction according to claim 1, characterised in that the displacement member comprises a pivotable arm (5,17',56,63), each connecting element being pivotably connected to a respective end of the arm.

4. Floating construction according to claim 1, characterised in that the displacement member comprises at least two arms (37,38) that are pivotably connected to one end of a respective pressure fluid cylinder (39,40) which is connected to the mounting frame (35), the cylinders being mutually connected by a fluid duct (45), wherein each arm pivotably carries a connecting element (43,44).

5. Floating construction according to claim 1, characterised in that the displacement member comprises at least two cable guide members (51,52), an upper end of each of the at least two connecting elements (43,44) being attached to a respective end of a cable (50) that extends from a first of the two connecting elements (43), via the cable guide members (51,52), to a second of the two connecting elements (44).

6. Floating construction according to claim 5, characterised in that the cable (50) comprises an elastic section (55).

7. Floating construction according to claim 1, characterised in that the construction comprises a pivotable deck structure (17',63) which is pivotably coupled to the at least two connecting elements.

8. Floating construction according to claim 1, characterised in that the mounting frame (17,35) is situated at or near the upper part (14,36) of the floating body, a guide frame (19,27,28,62,94) being connected at or near the lower part (18,67,100) of the floating body. (13,61,92), the at least two connecting elements being guided through respective passages in the guide frame.

9. Floating construction according to claim 8, characterised in that the guide frame (27,28,62,94) is pivotably connected to the floating body (13,61,92).

10. Floating construction according to claim 8, characterised in that the guide frame comprises for each connecting element a sleeve (75,76) which is pivotably attached to a radial arm (73) connected to the lower part (67) of the floating body.

11. Floating construction according to claim 10, characterised in that the sleeves (75,76) comprise near their edges a relatively compliant lining material (79,79').

12. Floating construction according to claim 10, characterised in that the radial arm (73) is connected to a central pivot (74) at or near the vertical center line of the floating body.

13. Floating construction according to claim 10, characterised in that the sleeves (75,76) are placed on the guide frame at spaced angular positions, and wherein the guide frame is circular.

14. Floating construction according to claim 10, characterised in that the at least two connecting elements are in a region of the sleeves provided with a contact member (80,81,83) for contacting the internal wall of the sleeves (75,84).

15. Floating construction according to claim 14, characterised in that a stopper (82) is placed around the at least two connecting elements and is attached to the contact members (80,81,83) for engaging with the sleeves (75,76) to position the contact members (80,81,83) within the sleeves (75,76), a pulling device (89) being connected to the stopper (82) and the contact members (80,81,83) for pulling them along the at least two connecting elements.

16. Floating construction according to claim 1, characterised in that, the at least two connecting elements comprise risers (15,16; 43,44; 59,60), wherein the floating construction is anchored to the seabed by at least one tether (24,64, 65,105).

17. Floating construction according to claim 16, characterised in that the risers and a number of tethers are placed in a circular, alternating configuration.

18. Floating construction according to claim 16, characterised in that the risers and the at least one tether are attached to the upper part (66) of the floating body (61).

19. Floating construction according to claim 16, characterised in that the at least one tether is attached to the lower part (18,67,100) of the floating body, or to the guide frame (62).

20. Floating construction according to claim 1, connected to a well head on the sea bed, characterised in that the risers are rigid steel tubes connected to the well head via a flexible joint, a stress joint or a pivot joint.

21. Floating construction according to claim 1, characterised in that the at least two connecting elements are tethers that are anchored in a cavity (71) of a template (69) on the seabed, the cavity forming a compression space allowing an axial depression of the at least two connecting elements.

22. Floating construction according to claim 1, comprising on each side of the vertical center line (106) at least two axially spaced mooring line sections (109,109"; 115,116).

23. Floating construction according to claim 22, wherein the axially spaced mooring line sections are formed by a mooring line having a first section (109) extending from the seabed to a first guide element (111) on the floating body, a second section (109') extending axially from the first guide element (111) to second guide element (112) and a third section (109") extending from the second guide element (112) back in the direction of the seabed or in the direction of the first section (109) of the mooring line (107).

24. Floating construction according to claim 22, wherein the axially spaced mooring lines comprise an upper and a lower mooring line (115,116) extending from the seabed on one side of the vertical center line (106) of the floating body, to a cable guide means on the floating body.

25. Floating construction according to claim 24, wherein each upper and lower mooring line (115,116) is formed of a single mooring line extending on each side of the vertical center line (106).

* * * * *